US010134276B1

(12) United States Patent
Barker

(10) Patent No.: US 10,134,276 B1
(45) Date of Patent: Nov. 20, 2018

(54) TRAFFIC INTERSECTION DISTANCE ANAYLTICS SYSTEM

(71) Applicant: International Business Machines Corporation, Armonk, NY (US)

(72) Inventor: Marshall Barker, Melbourne (AU)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/829,280

(22) Filed: Dec. 1, 2017

(51) Int. Cl.

| | |
|---|---|
| ***G08G 1/095*** | (2006.01) |
| ***G08G 1/07*** | (2006.01) |
| ***G08G 1/01*** | (2006.01) |
| *G08G 1/16* | (2006.01) |

(52) U.S. Cl.
CPC ..... *G08G 1/07* (2013.01); *G08G 1/0125* (2013.01); *G08G 1/166* (2013.01)

(58) Field of Classification Search
CPC ..... G08G 1/07; G08G 1/0125; G08G 1/164
USPC ..... 340/907
See application file for complete search history.

(56) References Cited

U.S. PATENT DOCUMENTS

| | | | | |
|---|---|---|---|---|
| 5,777,564 | A * | 7/1998 | Jones | G08G 1/08 340/907 |
| 8,502,697 | B2 * | 8/2013 | Bushman | G08G 1/164 340/907 |
| 9,472,097 | B2 | 10/2016 | Stelzig et al. | |
| 9,558,666 | B2 | 1/2017 | Jansson et al. | |
| 9,623,870 | B2 | 4/2017 | Kuroki et al. | |
| 9,707,960 | B2 * | 7/2017 | Gutmann | B60W 30/09 |
| 2011/0298603 | A1 | 12/2011 | King et al. | |
| 2016/0082978 | A1 | 3/2016 | Ozaki et al. | |
| 2016/0185347 | A1 | 6/2016 | Lefevre et al. | |

(Continued)

FOREIGN PATENT DOCUMENTS

| | | |
|---|---|---|
| JP | 5900640 B1 | 4/2016 |

OTHER PUBLICATIONS

Chan et al., "Traffic Monitoring at Signal-Controlled Intersections and Data Mining for Safety Applications", 2004 IEEE Intelligent Transportation Systems Conference, Washington, DC, USA, Oct. 3-6, 2004, pp. 355-360.

(Continued)

*Primary Examiner* — John A Tweel, Jr.
(74) *Attorney, Agent, or Firm* — Scully, Scott, Murphy & Presser, P.C.; Scott Dobson, Esq.

(57) ABSTRACT

A method, system, and computer readable program product are disclosed for traffic intersection distance signaling. In an embodiment, the method comprises determining a distance between a first vehicle and a traffic intersection, said first vehicle being on a first side of the intersection; using this determined distance to determine if a pre-defined distance is available between the first vehicle and the intersection; and when this pre-defined distance is available between the first vehicle and the intersection, signaling to a second vehicle, on a second side of the intersection, that space is available for the second vehicle on the first side of the intersection. In embodiments of the invention, the method further comprises measuring a specified length of the second vehicle, and the pre-defined distance is based on this measured specified length. In an embodiment, the predefined distance is equal to or greater than this measured specified length.

20 Claims, 3 Drawing Sheets

(56) References Cited

U.S. PATENT DOCUMENTS

2017/0069203 A1 3/2017 Sharma

OTHER PUBLICATIONS

Pyykonen et al., "Traffic Monitoring and Modeling for Intersection Safety", Conference Paper—Sep. 2010, Proceedings 2010 IEEE 6th International Conference on Intelligent Computer Communication and Processing Cluj-Napoca, Romania, Aug. 26-28, 2010, pp. 401-408.

* cited by examiner

TRAFFIC INTERSECTION DISTANCE ANAYLTICS SYSTEM

BACKGROUND

This invention generally relates to vehicle analysis at traffic intersections, and more specifically, to analyzing vehicles at traffic intersections to help drivers determine when they are able to pass through the intersection.

A roadway intersection is a planned point of conflict in a roadway system where vehicles, pedestrians, cyclists, and other roadway users come together from various directions. With different crossing and entering movements by both drivers and pedestrians, an intersection is one of the most complex traffic situations that motorists encounter. To allow traffic from different directions to pass safely through, the intersection is often signalized, often by signal lights to indicate to vehicles from each of the approaching directions when the vehicles have the right to pass through the intersection and when the vehicles are required to stop and not enter the intersection.

One very significant problem that often occurs at many intersections is to determine whether a vehicle can pass entirely through the intersection. When a vehicle is sitting in traffic and waiting to travel through an intersection, it can be difficult for the driver of the vehicle to see whether there is enough space available on the other side of the intersection for the car to move into so that if the driver enters and attempts to cross the intersection, the vehicle is able to pass completely through the intersection and the rear section of the car does remain within the intersection.

SUMMARY

Embodiments of the invention provide a method, system, and computer readable program product for traffic intersection distance signaling. In an embodiment, the method comprises determining a distance between a specified traffic intersection and a first vehicle on a first side of the traffic intersection; using said determined distance to determine if a pre-defined distance is available between the first vehicle and the traffic intersection; and when the pre-defined distance is available between the first vehicle and the traffic intersection, signaling to a second vehicle, on a second side of the traffic intersection, that space is available for the second vehicle on the first side of the intersection.

In an embodiment, the traffic intersection distance signaling system comprises a display unit for producing signaling messages; and a sub-system for determining a distance between a a specified traffic intersection and a first vehicle on a first side of the traffic intersection; and for using said determined distance to determine if a pre-defined distance is available between the first vehicle and the traffic intersection. When the pre-defined distance is available between the first vehicle and the traffic intersection, the sub-system transmits a control signal to the display unit to display a signal to a second vehicle, on a second side of the traffic intersection, that space is available for the second vehicle on the first side of the traffic intersection.

Embodiments of the invention ensure there is enough space available for a vehicle to safely enter and exit a traffic intersection. In an embodiment, the invention provides a method comprising: including distance measuring sensor (IoT) affixed onto an existing traffic light pole; including an electronic display sign also affixed to the existing traffic light pole; and including either a Wi-Fi or radio transceiver device positioned with the sensor and display to send collected data to a local system. The local system (which may be positioned within a traffic management junction box) collects all of the analytic distance data.

Embodiments of the invention provide a number of important advantages. Embodiments of the invention may be used to reduce congestion inside a traffic intersection, to assist the flow of traffic through the intersection, and to reduce the amount of driver aggression due to incorrect decisions made. Embodiments of the invention also collect analytics about the numbers of intersections where drivers are constantly causing traffic delays.

DETAILED DESCRIPTION

Figure 1:
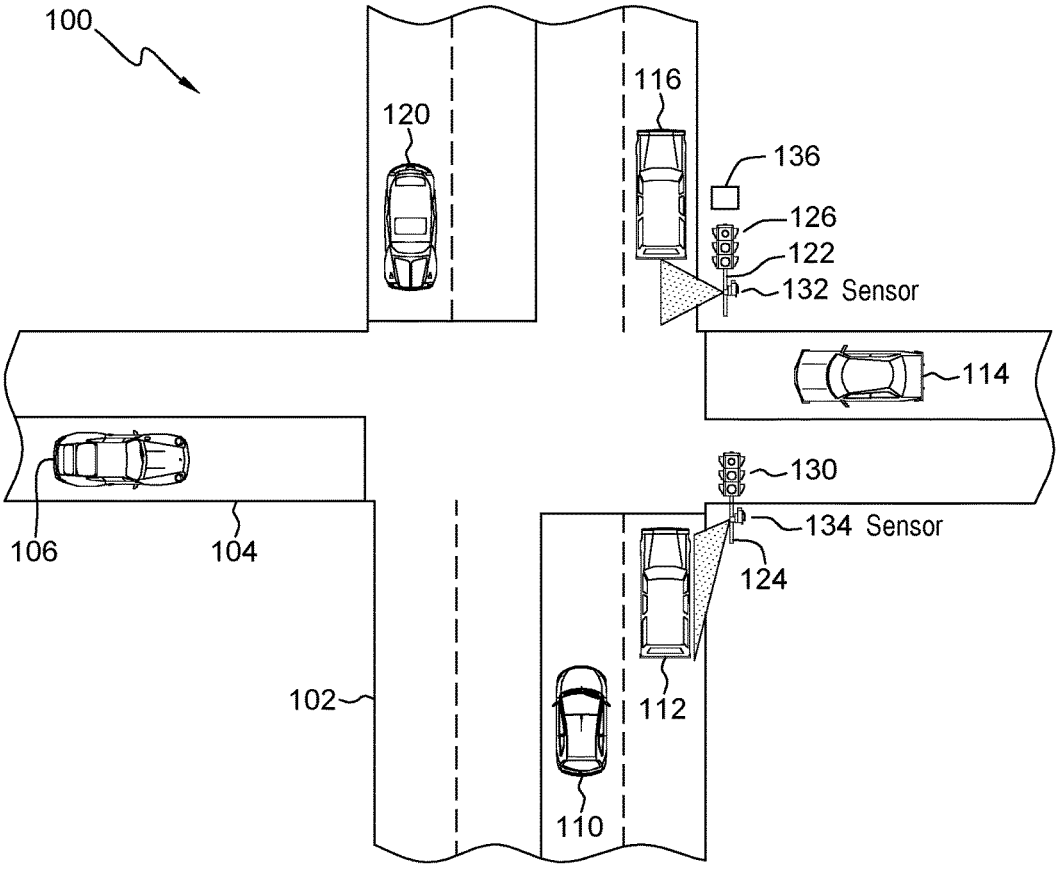
FIG. 1 illustrates a traffic intersection at which embodiments of the invention may be used.

This invention relates to analyzing vehicles at traffic intersections to help drivers determine when they are able to pass through the intersection. FIG. 1 illustrates a traffic intersection 100 at which embodiments of the invention may be used. The traffic intersection is formed by two intersecting, perpendicular roads 102 and 104 and has four sides. FIG. 1 shows a group of cars 106, 110, 112, 114, 116 and 120 at or adjacent the intersection, two traffic light poles 122 and 124, traffic signals 126 and 130, a plurality of distance measuring sensors 132 and 134, and electronic display 136.

As illustrated in FIG. 1, cars 112 and 116 are travelling in a first direction on street 102, with car 112 on one side of the intersection 100, and with car 116 on the opposite side of the intersection, having just exited the intersection. Cars 106 and 114 are approaching the intersection from opposite directions on cross street 104.

Also as shown in FIG. 1, the traffic signals 126, 130 are mounted on the traffic light poles 122, 124. The traffic signals are controlled by a traffic lights signal controller (not shown) that is typically located in a cabinet (not shown) near the intersection.

As will be understood by those of ordinary skill in the art, intersection 100 may have additional features not specifically shown in FIG. 1. For example, the intersection may have more traffic light poles and traffic signals than are shown in FIG. 1, and the intersection may have pedestrian crosswalks and crosswalk signals. The crosswalk signals may be controlled by a pedestrian signals controller that may be located in the same cabinet with the traffic lights signal controller. Further, although a four sided intersection is illustrated in FIG. 1, the invention may be used with intersections having other numbers of sides.

In other embodiments of the invention, the traffic lights controller and the pedestrian signals controller could be located separate from each other, or in other locations, such as in boxes on or in the traffic poles, or underground, or using other methods known in the art.

Embodiments of the invention use the measuring sensors 132 and 134 and the electronic display 136 to advise drivers when they can proceed across the intersection 100. In embodiments of the invention, the distance measuring sensors 132, 134 are positioned on traffic light poles 122, 124, on opposite sides of the intersection, and the sensors measure lengths and distances. Sensor 132 measures the distance behind car 116 and the near edge of the intersection, and sensor 134 measures the size or length of car 112, and the distance display 136 provides a display that advises whether there is enough space available behind car 116 for car 112. Distance display 136 may also be mounted on traffic light pole 122.

In embodiments of the invention, the data processing needed to make the above measurements may be done by sensors 132 and 134, and one or the other of the sensors may communicate with the electronic display 136 to cause that display to show the appropriate information.

Figure 2:
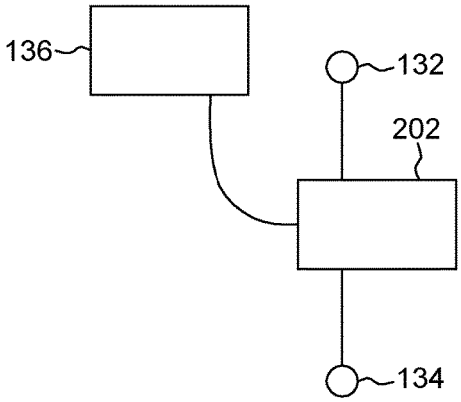
FIG. 2 shows a controller that may be used in embodiments of the invention.

In other embodiments, a separate controller, as shown at 202 in FIG. 2, may be used to receive data from sensors 132 and 134, process that data, and transmit a signal to display 136 to indicate to a driver whether there is sufficient space on the other side of the intersection for the driver's car. Any suitable controller may be used, and for example, the controller 202 may be a computer system or data processing system. Controller 202 may be located in the same cabinet with the traffic lights signal controller and the pedestrian crosswalk signal controller.

In the operation of the embodiment illustrated in FIGS. 1 and 2, sensors 132 and 134 collect data on the speed, location and size of vehicles at and adjacent the intersection. The sensors transmit this data to controller 202 which uses the data, along with additional data that may be collected, to determine the length or size of vehicles on the entering side of the intersection and the space behind vehicles exiting the intersection.

In an alternate embodiment, only one measurement is taken at the intersection 100, and that measurement is the distance between car 116 and the intersection. The question of whether the next car can enter and exit the intersection can be answered based on pre-determined information such as the length of an average car.

Figure 3:
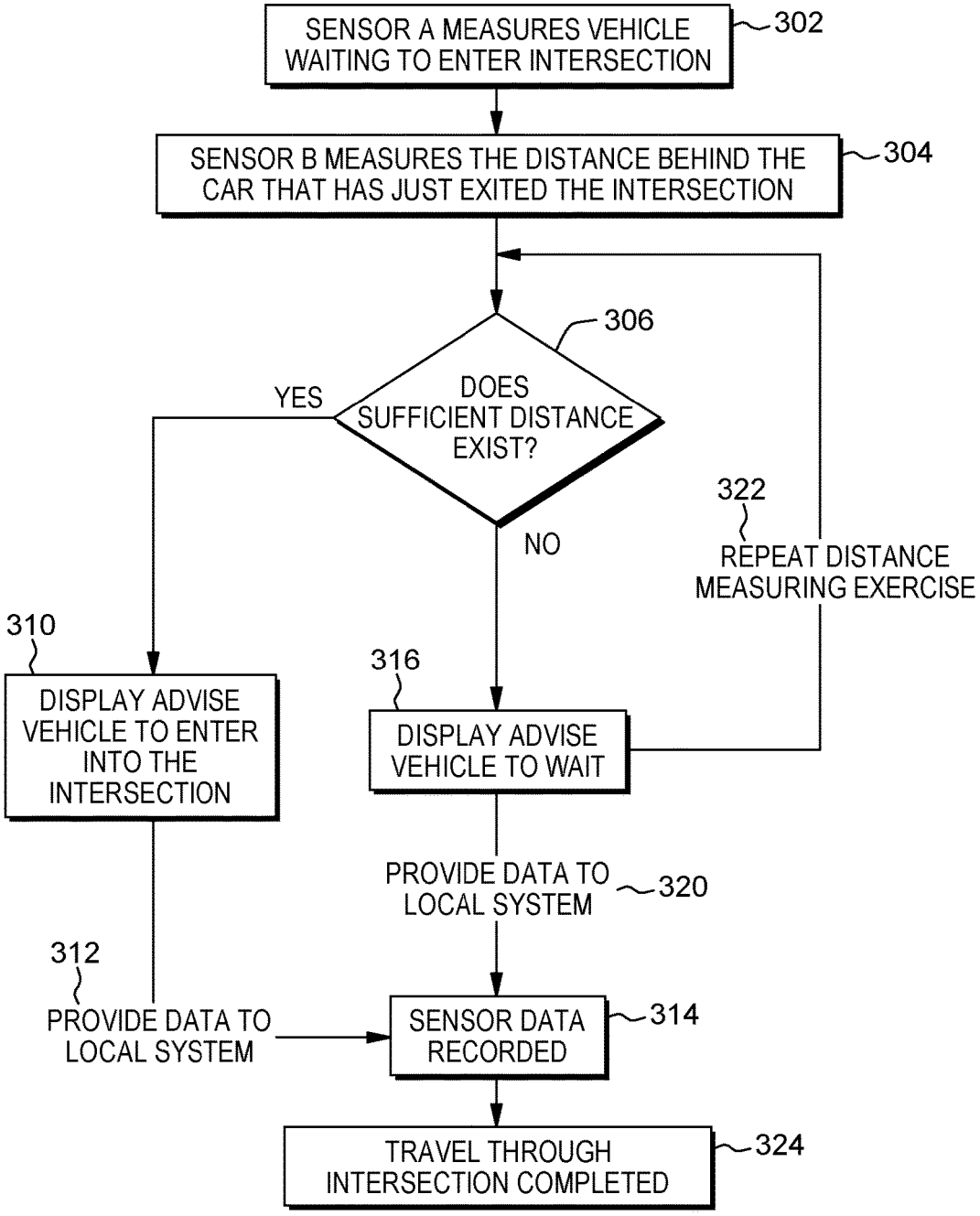
FIG. 3 is a process flow illustrating an embodiment of the invention.

FIG. 3 is a flow chart showing a method of an embodiment of the invention. At 302, sensor 134 measures the vehicle 112 waiting to enter the intersection 100, and at 304, sensor 132 measures the distance behind the car 116 that has just exited the intersection. At 306, a determination is made as to whether there is sufficient distance for car 112 behind car 116, so that car 112 can pass entirely through the intersection and move into the space behind car 116 without any part of the car 112 remaining in the intersection.

If there is sufficient distance behind car 116, the process moves to 310, and display 136 is used to advise vehicle 112 to enter into the intersection. At 312, data from the sensors 132 and 134 are provided to a local data system, and the data from the sensors are recorded at 314.

If, at 306, there is insufficient distance behind car 116, the process moves from 306 to 316, and display 136 is used to advise vehicle 112 to wait before entering the intersection. After 316, the data from the sensors are provided to the local data system at 320, and the sensor data are recorded at 314. Also, as represented at 322, sensors 132 and 134 continue to measure the vehicle 112 waiting to enter the intersection, and the distance behind vehicle 132, and steps 306 and 316 are repeated until there is sufficient room behind car 116 for car 112, and the process moves from 306 to 310.

From 310, the process moves to 312 and 314, and when the travel through the intersection is completed at 324, the process ends.

Any suitable type of sensors may be used as sensors 132 and 134. For instance, the sensors may be cameras or video devices that provide image data of the relevant space or spaces, and the image data from the sensors may be processed to determine the distance between vehicle 116 and the intersection 100 and the length of vehicle 112. Radar may also be used to detect objects in and proximate traffic intersection 100 and to communicate data on the position and velocity of the detected objects.

Devices of the type referred to as the Internet of Things (IoT) devices may also be used to obtain data about the vehicles at the intersection. Examples of IoT devices that may be used in embodiments of the invention include monitoring cameras, pressure sensors, sound sensors or microphones, and motion sensors. These IoT devices may have their own processing and data storage capabilities and may communicate with each other as well as with controller 202 or sensors 132, 134.

Any suitable device may be used as electronic display 136. For example, the display 136 may be a video screen, an LED display, an LCD display, or one light or a series of lights. Also, the display may show only a simple message, or may be only a light of a particular color or shape, or an arrow or some other suitable indicia that indicates to a driver that there is sufficient space across the intersection for the driver's vehicle.

Figure 4:
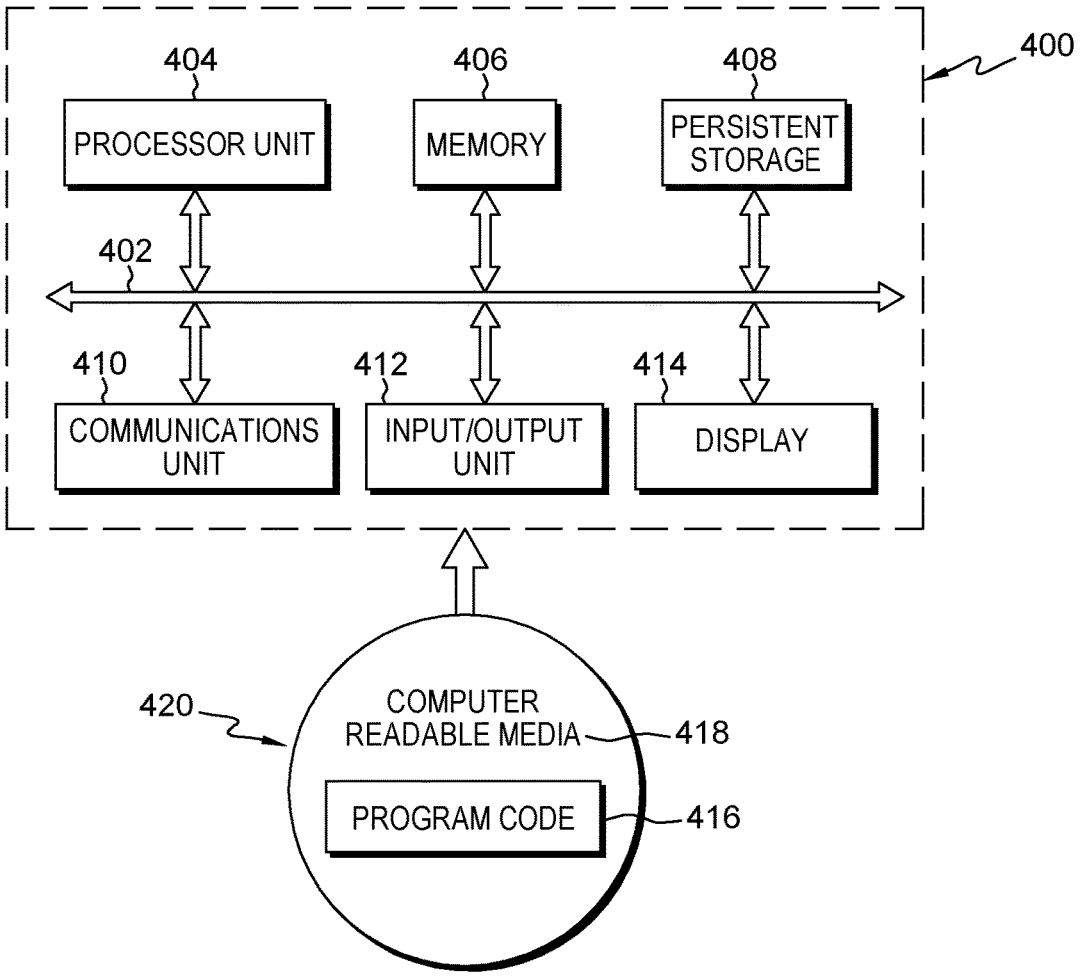
FIG. 4 shows a data processing system that may be used in embodiments of the invention.

With reference to FIG. 4, a block diagram of a data processing system 400 is shown. Data processing system 400 is an example of a processing unit that may be used as, in, or with controller 202 of FIG. 2. Data processing system 400 may also be used in or directly with sensors 132, 134 and electronic display 136.

In this illustrative example, data processing system 400 includes communications fabric 402, which provides communications between processor unit 404, memory 406, persistent storage 408, communications unit 410, input/output (I/O) unit 412, and display 414.

Processor unit 404 serves to execute instructions for software that may be loaded into memory 406. Processor unit 404 may be a set of one or more processors or may be a multi-processor core, depending on the particular implementation. Memory 406 and persistent storage 408 are examples of storage devices. Memory 406, in these examples, may be a random access memory or any other suitable volatile or non-volatile storage device. Persistent storage 408 may take various forms depending on the particular implementation. For example, persistent storage 408 may be a hard drive, a flash memory, a rewritable optical disk, a rewritable magnetic tape, or some combination of the above.

Communications unit 410, in these examples, provides for communications with other data processing systems or devices. In these examples, communications unit 410 is a network interface card. Communications unit 410 may provide communications through the use of either or both physical and wireless communications links. Input/output unit 412 allows for input and output of data with other devices that may be connected to data processing system 400. For example, input/output unit 412 may provide a connection for user input through a keyboard and mouse. Further, input/output unit 412 may send output to a printer. Display 414 provides a mechanism to display information to a user.

Those of ordinary skill in the art will appreciate that the hardware in FIG. 4 may vary depending on the implementation. Other internal hardware or peripheral devices, such as flash memory, equivalent non-volatile memory, or optical disk drives and the like, may be used in addition to or in place of the hardware depicted in FIG. 4.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The description of the invention has been presented for purposes of illustration and description, and is not intended to be exhaustive or to limit the invention in the form disclosed. Many modifications and variations will be apparent to those of ordinary skill in the art without departing from the scope of the invention. The embodiments were chosen and described in order to explain the principles and applications of the invention, and to enable others of ordinary skill in the art to understand the invention. The invention may be implemented in various embodiments with various modifications as are suited to a particular contemplated use.

The invention claimed is:

1. A traffic intersection distance signaling method, comprising:

determining a distance between a first vehicle and a specified traffic intersection, said first vehicle being on a first side of the traffic intersection;

using said determined distance to determine if a pre-defined distance is available between the first vehicle and the traffic intersection; and when a pre-defined distance is available between the first vehicle and the traffic intersection, signaling to a second vehicle, on a second side of the traffic intersection, that space is available for the second vehicle on the first side of the intersection.

2. The method according to claim 1, further comprising measuring a specified length of the second vehicle, and said pre-defined distance is based on said measured specified length.

3. The method according to claim 2, wherein the pre-defined distance is equal to or greater than the measured specified length of the second vehicle.

4. The method according to claim 1, wherein the using said determined distance to determine if a pre-defined distance is available between the first vehicle and the traffic intersection includes comparing said determined distance to specified criteria to determine if the pre-defined distance is available between the first vehicle and the traffic intersection.

5. The method according to claim 4, wherein the determining a distance between the first vehicle and the traffic intersection includes monitoring said distance between the first vehicle and the traffic intersection over a period of time.

6. The method according to claim 5, wherein:

when the pre-defined distance is not available between the first vehicle and the traffic intersection, repeating the comparing said determined distance to specified criteria one or more times over the period of time.

7. The method according to claim 5, wherein:

when the pre-defined distance is not available between the first vehicle and the traffic intersection, signaling to the second vehicle to wait before entering the traffic intersection.

8. The method according to claim 1, wherein:

the determining a distance between the first vehicle and the traffic intersection includes using a first sensor to obtain data for measuring said distance; and the method further comprising using a second sensor to obtain data for measuring a specified length of the second vehicle.

9. The method according to claim 8, wherein:

the signaling to the second vehicle includes using a display unit to provide the signaling; and the method further comprises:

using a controller to receive the data from the first and second sensors and to process the data to determine when the pre-defined distance is available; and the signaling to the second vehicle includes, when the predetermined distance is available, the controller sending a signal to the display to provide the signaling.

10. The method according to claim 8, wherein the first sensor is located on the first side of the traffic intersection, and the second sensor is located on the second side of the traffic intersection.

11. A traffic intersection distance signaling system, comprising:

a display unit for producing signaling messages: and a sub-system for determining a distance between a first vehicle and a specified traffic intersection, said first vehicle being on a first side of the traffic intersection; for using said determined distance to determine if a pre-defined distance is available between the first vehicle and the traffic intersection; and when a pre-defined distance is available between the first vehicle and the traffic intersection, for transmitting a control signal to the display unit to display a signal to a second vehicle, on a second side of the traffic intersection, that space is available for the second vehicle on the first side of the traffic intersection.

12. The traffic intersection distance signaling system according to claim 11, wherein the sub-system includes a first sensor to obtain data for measuring the distance between the first vehicle and the intersection; and a second sensor to obtain data for measuring a specified length of the second vehicle.

13. The traffic intersection distance signaling system according to claim 12, wherein the sub-system further includes:

a controller to receive the data from the first and second sensors and to process the data to determine when the pre-defined distance is available.

14. The traffic intersection distance signaling system according to claim 13, wherein, when the predetermined distance is available, the controller sends the control signal to the display unit to provide the signal to the second vehicle that space is available for the second vehicle on the first side of the traffic intersection.

15. The traffic intersection distance signaling system according to claim 12, wherein:

the first sensor is located on the first side of the traffic intersection; and the second sensor is located on the second side of the traffic intersection.

16. A computer readable program storage device for traffic intersection distance signaling, the computer readable program product comprising:

a computer readable storage medium having program instructions embodied therein, the program instructions executable by a computer to cause the computer to perform the method of:

determining a distance between a first vehicle and a specified traffic intersection, said first vehicle being on a first side of the traffic intersection;

using said determined distance to determine if a pre-defined distance is available between the first vehicle and the intersection; and when a pre-defined distance is available between the first vehicle and the intersection, signaling to a second vehicle, on a second side of the intersection, that space is available for the second vehicle on the first side of the intersection.

17. The computer readable program product according to claim 16, wherein the method further comprises:

measuring a specified length of the second vehicle, and said pre-defined distance is based on said measured specified length.

18. The computer readable program product according to claim 17, wherein the predefined distance is equal to or greater than the measured specified length of the second vehicle.

19. The computer readable program product according to claim 16, wherein the using said determined distance to determine if a pre-defined distance is available between the first vehicle and the intersection includes comparing said determined distance to specified criteria to determine if the pre-defined distance is available between the first vehicle and the intersection.

20. The computer readable program product according to claim 19, wherein:

the determining a distance between the first vehicle and the intersection includes monitoring said distance between the first vehicle and the intersection over a period of time; and when the pre-defined distance is not available between the first vehicle and the intersection, repeating the comparing said determined distance to specified criteria one or more times over the period of time.

* * * * *